US006622666B2

(12) United States Patent
Kuji

(10) Patent No.: US 6,622,666 B2
(45) Date of Patent: Sep. 23, 2003

(54) ENGINE COOLING SYSTEM FOR ALL-TERRAIN VEHICLE

(75) Inventor: Yasuhiro Kuji, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/051,108

(22) Filed: Jan. 22, 2002

(65) Prior Publication Data

US 2002/0096131 A1 Jul. 25, 2002

(30) Foreign Application Priority Data

Jan. 23, 2001 (JP) ..... 2001-014570

(51) Int. Cl.[7] ..... F01P 7/14
(52) U.S. Cl. ..... 123/41.1
(58) Field of Search ..... 123/41.1, 41.44, 123/41.72, 41.52, 41.33, 41.47, 41.82 R; 180/68.2, 68.3, 68.1

(56) References Cited

U.S. PATENT DOCUMENTS 5,410,991 A * 5/1995 Beaudry et al. ..... 123/41.1
6,454,040 B1 * 9/2002 Fukuda ..... 180/374

FOREIGN PATENT DOCUMENTS

JP 3-117614 5/1991
JP 5-10743 U 2/1993

* cited by examiner

*Primary Examiner*—Henry C. Yuen
*Assistant Examiner*—Hyder Ali
(74) *Attorney, Agent, or Firm*—Oliff & Berridge, PLC

(57) ABSTRACT

An engine cooling system for an all-terrain vehicle provided with a front fender (12), and an engine (3) provided with water jackets and mounted on a body frame (F) at a position between front and rear wheels includes a radiator (45) provided with a water inlet (54) and disposed in a front part of the body frame (F), a water filling cup (16) provided with a water filling opening **(16*a*), and a thermostat case (17) holding a thermostat (17*a*) therein. The water filling cup (16) is separated from the radiator (45). The water filling cup (16) and the thermostat case (17) are placed in a part of a connecting pipe connecting the water inlet(54) of the radiator (45) and the outlets (57, 58) of the water jackets of the engine (3) at the highest level in a cooling water circulating passage. A protruded portion (18) is formed on the front fender (12) so as to surround a steering shaft, and the water filling cup (16) and the thermostat case (17) are placed inside the protruded portion (18)**.

11 Claims, 6 Drawing Sheets

ENGINE COOLING SYSTEM FOR ALL-TERRAIN VEHICLE

BACKGROUND OF THE INVENTION

1. Field of the Invention

The present invention relates to an engine cooling system for an all-terrain vehicle provided with a water-cooled engine.

2. Description of the Related Art

Referring to FIG. 8, a conventional engine cooling system for an all-terrain vehicle provided with a water-cooled engine includes a radiator 101, a cooling fan 102 disposed behind the radiator 101, and a water reserve tank, not shown. The radiator 101 is covered with the front fender of the vehicle. A water filler port 106 is formed in the upper wall of the radiator 101 and is closed by a radiator cap 109 detachably attached to the radiator 101. A water inlet 110 is formed in one upper corner of the rear surface of the radiator 101 at a level at a predetermined distance below the upper end of the radiator 101. A water outlet 111 is formed in one lower corner of the rear surface of the radiator 101. The water inlet 110 is connected to an outlet 113 of the water jacket of the engine by a return pipe 112. The water outlet 111 is connected to a water pump 103 by a water supply pipe 116. A thermostat, not shown, is placed in a cooling water outlet formed in the cylinder head of the engine. Prior art relating with the present invention is disclosed in JP-U No. Hei 5-10743.

When the radiator 101 provided with the water filler port 106 formed in the upper wall thereof as shown in FIG. 8 is mounted on an all-terrain vehicle as shown in FIG. 1, the water filler port 106 is located near a position indicated by the arrow A in FIG. 1, i.e., a position near the lower surface of the front fender 12. Therefore, when supplying water into the radiator 101, the operator needs to reach out a hand through a gap between the lower surface of the front fender 12 and the upper end of a side panel 120 to remove the radiator cap 109, which requires difficult work for supplying water into the radiator 101.

The radiator 101 of the engine cooling system shown in FIG. 8 is provided with the water filler port 106 in its upper wall to place the water filler port 106 at a desired level. However, only a limited space is available in the body of the vehicle for placing the radiator 101 and there are restrictions on the level of the radiator 101. Consequently, the water filler port 106 cannot be located at a high level enough to secure a sufficient pressure head difference between the outlet 113 of the water jacket of the engine and the water filler port 106. Thus, air remaining in the radiator 101, the water jacket and the piping cannot be easily removed when supplying water into the radiator 101, water must be supplied at a low rate and the work for supplying water into the radiator 101 takes much time.

Since the water inlet 110 of the radiator 101 is formed at a level at a predetermined distance below the upper end of the radiator 101, air is not easy to escape from the radiator 101 when water is supplied into the radiator 101.

SUMMARY OF THE INVENTION

Accordingly, it is an object of the present invention to provide an engine cooling system for an all-terrain vehicle, including a radiator provided with a radiator cap which can be easily put on and removed from the radiator and capable of being supplied with water by simple, efficient work, and capable of making difficult the accumulation of air in cooling water circulating passages.

According to the present invention, an engine cooling system for an all-terrain vehicle provided with a front fender, a steering handlebar and an engine provided with a water jacket and mounted on a body frame at a position between front and rear wheels comprises a radiator provided with a water inlet and disposed in a front part of the body frame, a water filling cup provided with a water filling opening covered with a cap, said water filling cup being formed as a different body from the radiator and a thermostat case holding a thermostat therein; wherein the water filling cup and the thermostat case are placed in a part of a connecting pipe connecting the water inlet of the radiator and an outlet of the water jacket, at the highest level in a cooling water circulating passage and located in a space under the front fender and near the steering handlebar.

In the engine cooling system thus configured, the position of the water filling cup is not subject to restrictions placed by the disposition of the radiator and the water filling cup can be disposed in a proper space in the body frame, such as a space near the steering handlebar for the efficient use of the space in the body frame. A large pressure head difference can be secured between the water filling opening of the water filling cup and the outlet of the water jacket of the engine, air remaining in the cooling water passage can be smoothly removed, water supplying work can be efficiently achieved, and air will not accumulate in the water jacket of the engine.

Preferably, a protruded portion may be formed on the front fender so as to surround a steering shaft connected to the steering handlebar, the water filling cup and the thermostat case may be placed inside the protruded portion, and the protruded portion may be provided with an access opening for the water filling cap.

Thus the water filling opening and the thermostat can be easily disposed at a high level, and the cap of the water filling cup can be easily removed by reaching out a hand through the access opening to the cap, and water can be easily supplied through the water filling opening of the water filling cup into the radiator.

Preferably, the water inlet of the radiator may be formed in the upper wall of the radiator.

Thus the connecting pipe connecting the water inlet of the radiator and the outlet of the water jacket of the engine can be easily arranged and air can be easily removed from the cooling water passage.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
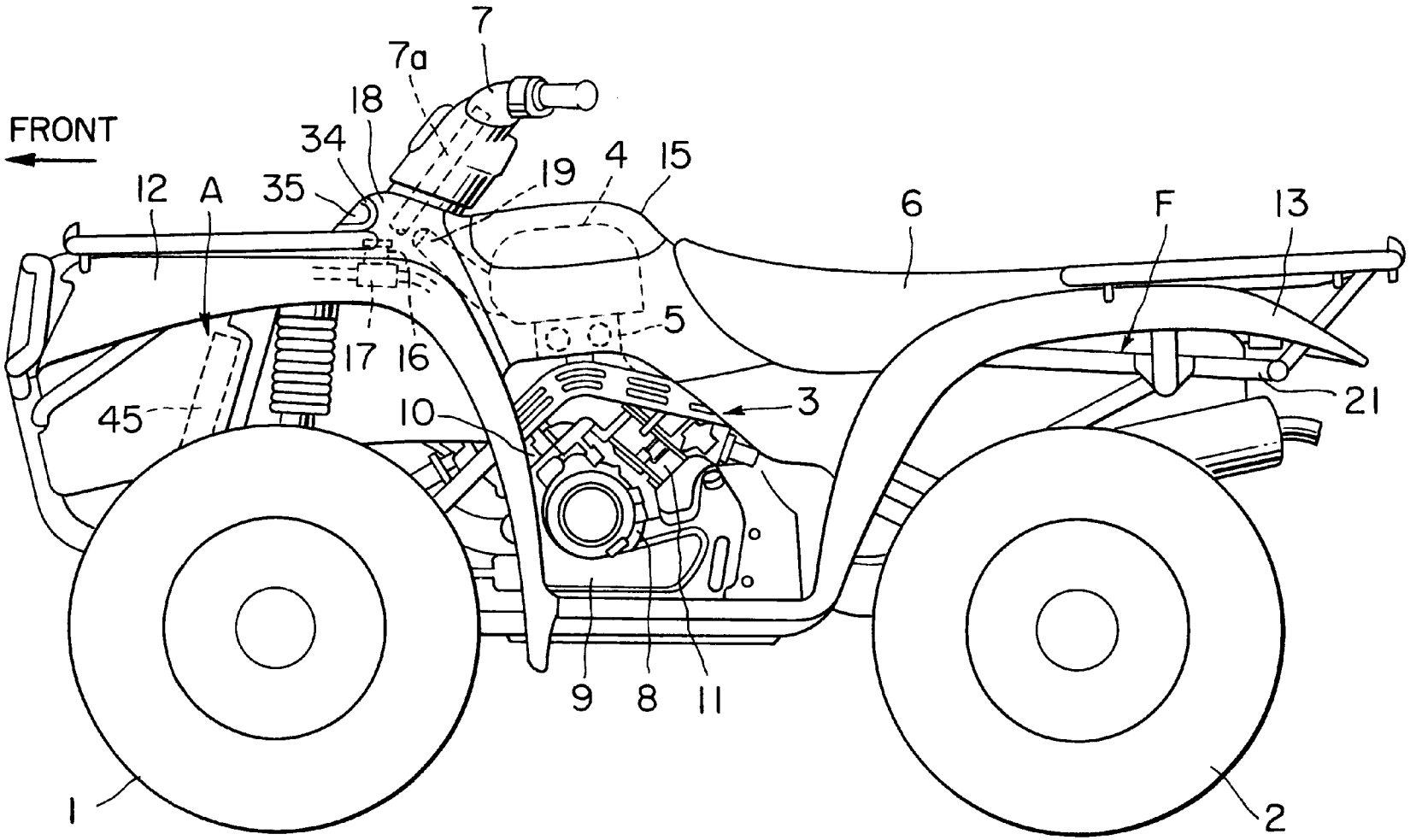
FIG. 1 is a side elevation of a saddle-type four-wheeled all-terrain vehicle equipped with an engine cooling system in a preferred embodiment according to the present invention.

Referring to FIG. 1 showing a saddle-type four-wheeled all-terrain vehicle equipped with an engine cooling system in a preferred embodiment according to the present invention, right and left front wheels 1 and right and left rear wheels 2 are suspended from a front part and a rear part, respectively, of a body frame F. A two-cylinder V engine 3 is mounted on a part of the body frame F between the front wheels 1 and the rear wheels 2. An air cleaner 4 and a carburetor 5 are disposed above the engine 3. A steering handlebar 7 is disposed above a front end part of the engine 3. The engine 3 has a crankcase 8, a front cylinder 10 tilted forward and held on the crankcase 8 and a rear cylinder 11 tilted rearward and held on the crankcase 8.

A front fender 12 is fixed to a front part of the body frame F, and a rear fender 13 is fixed to a rear part of the body frame F. A side cover 14 is joined to the rear edge of the front fender 12 so as to extend on the right and the left side of the air leaner 4 and the carburetor 5. An air cleaner cover 15 is detachably attached to an upper part of the side cover 14 so as to cover the air cleaner 4. A saddle-type seat 6 is disposed behind the side cover 14. A rear part of the seat 6 extends over the rear fender 13.

A protruded portion 18 is formed integrally with a rear end part of the front fender 12 so as to surround a steering shaft 7*a* connected to a handlebar 7. The protruded portion 18 surrounds a water filling cup 16 through which cooling water is supplied into a radiator 45, a thermostat case 17 and the air intake pipe 19 of the air cleaner 4. An access opening 34 is formed in a front part of the protruded portion 18, and a cover 35 is detachably attached to the protruded portion 18 so as to cover the access opening 34. A water reserve tank 9 is held on the left side wall of the crankcase 8 of the engine 3.

Figure 6:
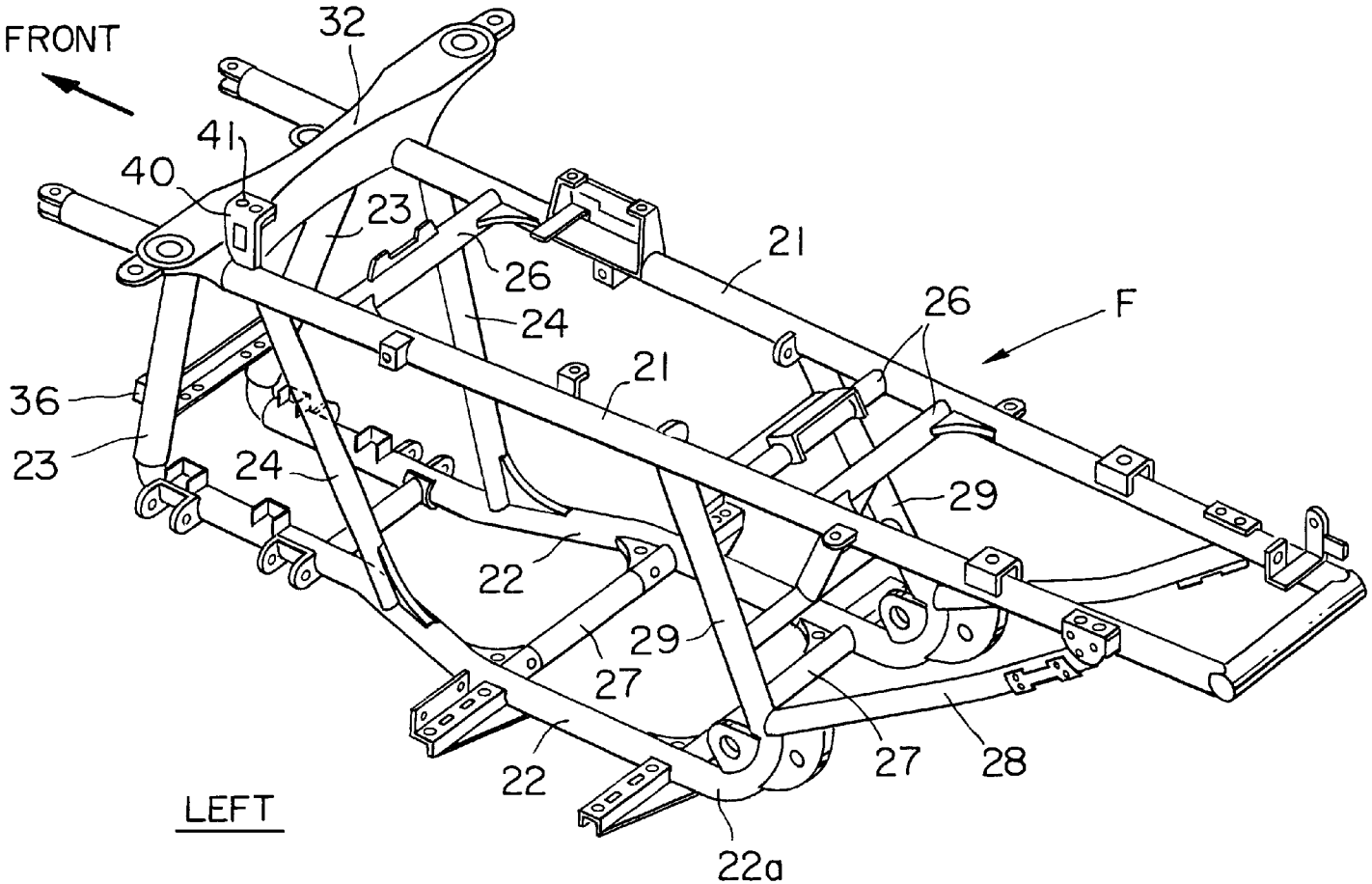
FIG. 6 is a perspective view of a body frame included in the all-terrain vehicle shown in FIG. 1.

Referring to FIG. 6 showing the body frame F in a perspective view, the body frame F is built by welding together a pair of upper longitudinal pipes 21, a pair of lower longitudinal pipes 22, first front pipes 23 connecting the respective front ends of the upper pipes 21 and the corresponding lower pipes 22, second front pipes 24 spaced a predetermined distance apart from the first front pipes 23 toward the rear and extended between the upper longitudinal pipes 21 and the lower longitudinal pipes 22, a plurality of upper cross pipes 26 extended between the right and the left upper longitudinal pipes 21, and a plurality of lower cross pipes 27 extended between the right and the left lower longitudinal pipes 22. Rear end parts of the lower longitudinal pipes 22 are bent obliquely upward in curved parts 22*a* to form rising parts 29 tilted forward. The upper ends of the rising parts 29 are welded to the upper longitudinal pipes 22. Rear support pipes 28 extending obliquely rearward and upward have front ends welded to the curved parts 22*a*, respectively, and rear ends welded to the rear ends of the upper longitudinal pipes 21, respectively.

The distance between the lower ends of the first front pipes 23 are shorter than that between the upper ends of the same, and the distance between the lower ends of the second front pipes 24 are shorter than that between the upper ends of the same. The first front pipes 23 are tilted rearward. The first front pipes 23 are provided with brackets 36 for holding the radiator 45. A suspension bracket 32 for supporting front suspensions is extended between parts of the upper longitudinal pipes 21 between the upper ends of the front pipes 23 and 24. A thermostat support bracket 40 for supporting the thermostat case 17 is welded to a part of the left, upper longitudinal pipe 21 at a position behind the suspension bracket 32. The bracket 40 has a cross section of an inverted letter L. The thermostat support bracket 40 has an upper part provided with a pair of through holes 41.

Figure 4:
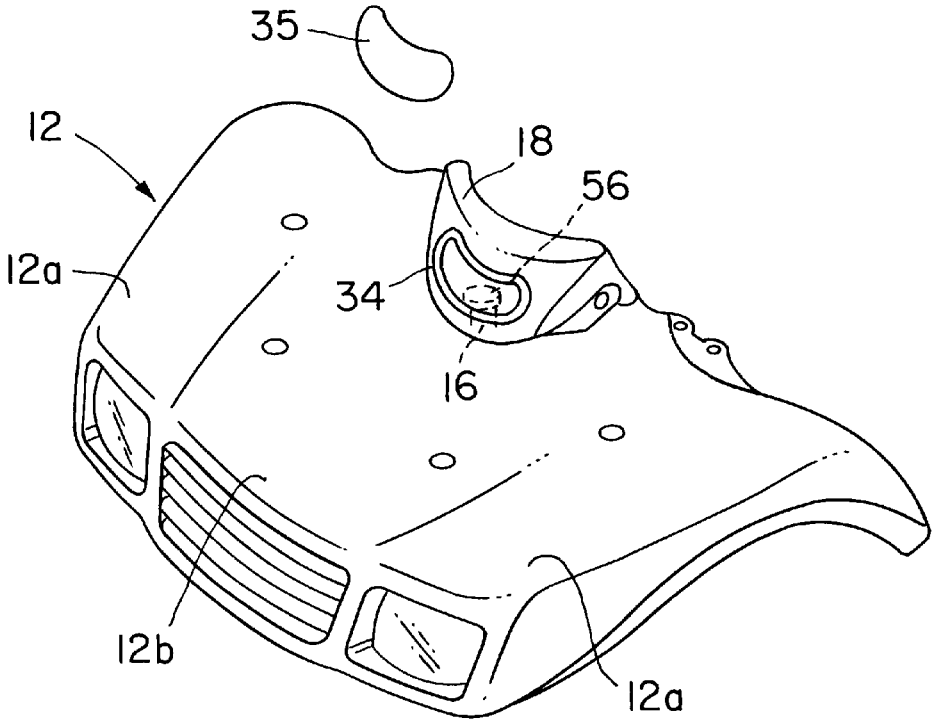
FIG. 4 is an exploded perspective view of a front fender.

Referring to FIG. 4 showing the front fender 12 in an exploded perspective view, the front fender 12 has right and left front wheel covering parts 12*a*, and a hood part 12*b* between the right and the left front wheel covering parts 12*a*. The protruded portion 18 is formed on a rear end part of the hood part 12*b*. The protruded portion 18 has the shape of a half frustum. The access opening 34 having a laterally elongate shape is formed in a curved front part of the protruded portion 18 and a groove is formed along the edge of the access opening 34. The cover 35 is detachably fitted in the groove formed along the edge of the access opening 34. The front fender 12 and the cover 35 are formed of the same resin.

Figure 5:
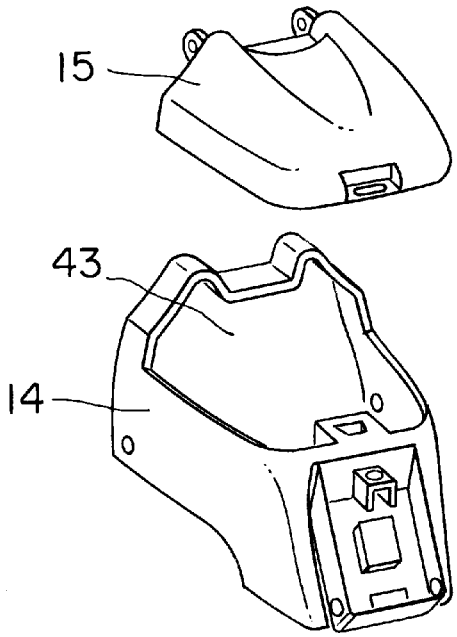
FIG. 5 is an exploded perspective view of a side cover.

As shown in FIG. 5, the side cover 14 has an upper access opening 43 to permit access to the air cleaner 4.

Figure 2:
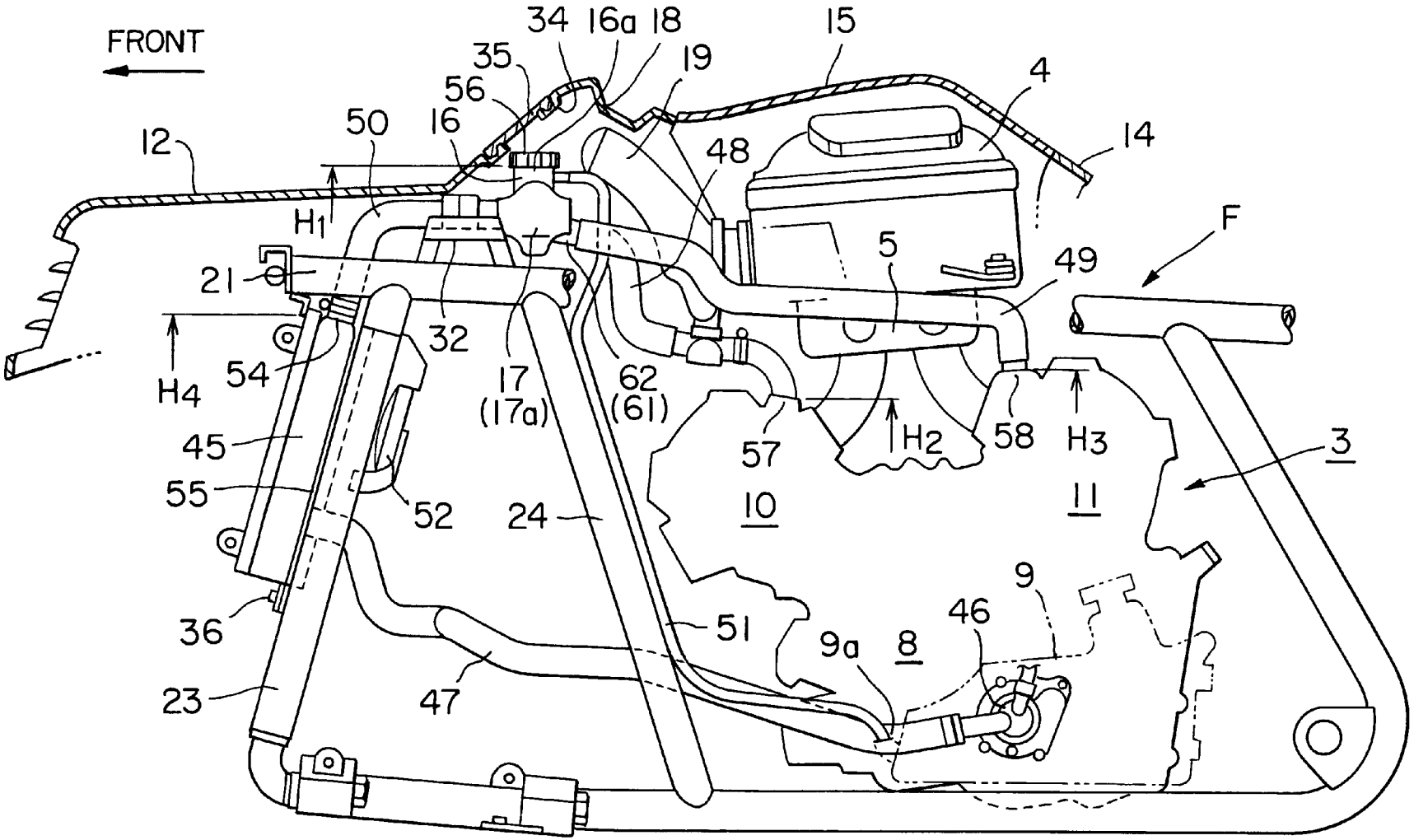
FIG. 2 is an enlarged side elevation of the engine cooling system shown in FIG. 1.

Referring to FIG. 2, engine cooling system includes the radiator 45 held on the brackets 36 in front of the first front pipes 23, a water pump 46 attached to a generator case, not shown, connected to the left side wall of the crankcase 8, the water filling cup 16 disposed in the protruded portion 18, the thermostat case 17 disposed in the protruded portion 18, the water jacket of the engine 3, the water reserve tank 9, a supply pipe 47, return pipes 48 and 49, a water hose 50 for the radiator 45, and a reserver pipe 51 connected to the water reserve tank 9.

The radiator 45 is held on the brackets 36 so as to extend in a tilted position along the first front pipes 23. A cooling fan 52 is disposed behind the radiator 45. The water inlet 54 is formed in a left end part of the upper wall of the radiator 45. The water hose 50 is connected to a water inlet 54. The supply pipe 47 has one end connected to a water outlet 55 formed in a lower right corner of the back surface of the radiator 45 and the other end connected to a suction port of the water pump 46.

A discharge port of the water pump 46 communicates with the water jackets of the cylinders 10 and 11 by means of cooling water passages formed in the generator case and the crankcase 8. The water jackets are connected to water outlets 57 and 58 formed in upper end parts of the cylinders 10 and 11. The return pipes 48 and 49 are connected to the water outlets 57 and 58 of the water jackets, respectively.

Figure 3:
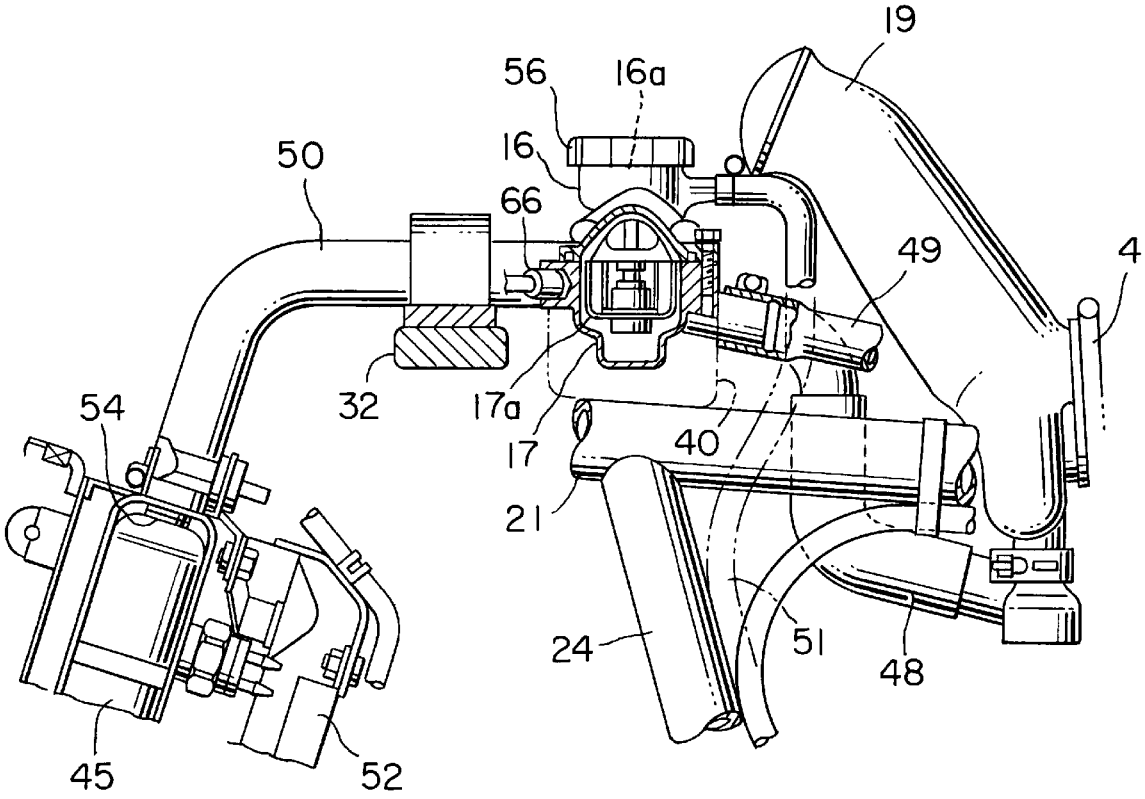
FIG. 3 is an enlarged side elevation of a thermostat case and a water filling cup shown in FIG. 2.

Referring to FIG. 3 showing the water filling cup 16 and the thermostat case 17 in an enlarged side elevation, the water filling cup 16 and the thermostat case 17 are separated from the radiator 45 and are disposed on levels above the upper longitudinal pipes 21. The thermostat case 17 is supported on the upper part of the thermostat support bracket 40. A thermostat 17*a* is held in the thermostat case 17. The thermostat 17*a* opens the water passage between the water outlets 57,58 of the water jacket and the water inlet 54 of the radiator 50 when the temperature of the cooling water rises beyond a predetermined temperature and closes the same while the temperature of the cooling water is below the predetermined temperature. An air passage is formed in the thermostat 17*a* to enable air to flow from a lower inlet side toward an upper outlet side even if the water passage is closed by the thermostat 17*a*. The water filling cup 16 has an upper water filling opening 16*a*. A cap 56 is attached to the water filling cup 16 so as to close the water filling opening 16*a*.

Figure 7:
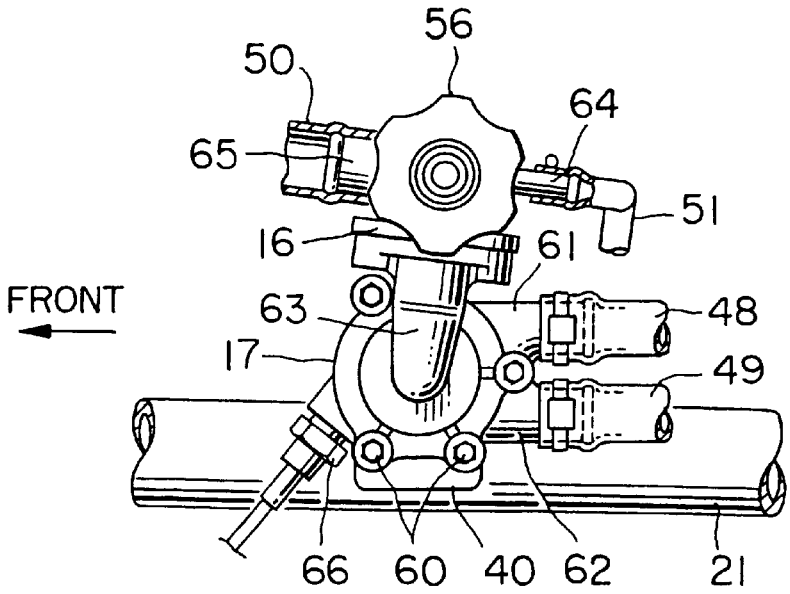
FIG. 7 is an enlarged plan view of the thermostat case and the water filling cup.
Figure 8:
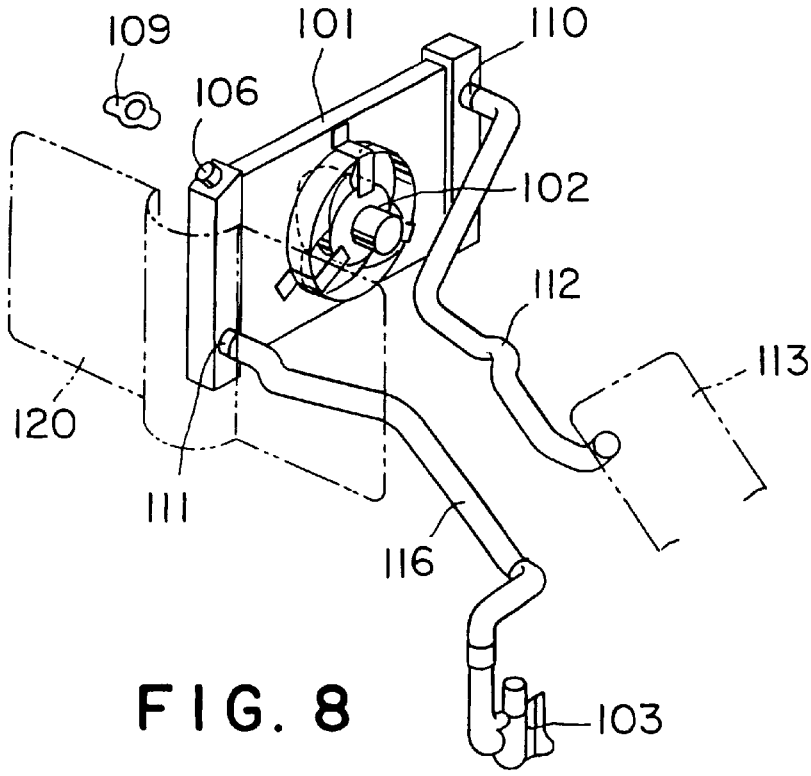
FIG. 8 RELATED ART
FIG. 8 is a perspective view of a conventional engine cooling system for an all terrain vehicle.

Referring to FIG. 7 showing the water filling cup 16 and the thermostat case 17 in a plan view, the thermostat case is fastened to the upper part of the bracket 40 with two bolts 60. Bifurcate water inlet pipes 61 and 62 are formed integrally with the thermostat case 17 so as to extend toward the rear. The return pipes 48 and 49 are connected to the water inlet pipes 61 and 62, respectively. A water outlet pipe 63 provided with a flange at its extremity is formed integrally with an upper part of the thermostat case 17 so as to extend toward the right. The water filling cup 16 is fastened to the flange of the water outlet pipe 63 with bolts. A connecting pipe 64 extends rearward from the water filling cup 16 and is connected to the water reserve tank 9 by the reserver pipe 51. A connecting pipe 65 extends forward from the water filling cup 16 and is connected to the radiator 45 by the water hose 50. The thermostat case 17 is provided with a temperature sensor 66 for measuring the temperature of the cooling water. A warning lamp placed on the instrument panel of the vehicle is turned on when the temperature measured by the temperature sensor 66 is higher than a predetermined temperature.

Referring again to FIG. 2, the reserver pipe 51 extends from the water filling cup 16 downward along the second front pipe 24 and is connected to a connecting pipe 9*a* projecting from a front part of the water reserve tank 9. The water hose 50 extends upward from the water inlet 54 formed in the upper wall of the radiator 45, is bent rearward at a position on a level above the upper longitudinal pipe 21 of the body frame F and slopes up gradually toward the water filling cup 16. A middle part of the water hose 50 is held through an elastic pad on the suspension bracket 32. The return pipes 48 and 49 slope up continuously from the water outlets 57 and 58 of the water jackets toward the thermostat case 17 and are connected to the water inlet pipes 61 and 62 of the thermostat case 17.

Thus the water filling cup 16 and the thermostat case 17 are disposed at the level above the upper longitudinal pipes 21 and at a position between the return pipes 48 and 49 connected to the water outlets 57 and 58 of the water jackets, and the water hose 50 connected to the water inlet 54 of the radiator 45, and the return pipes 48 and 49 and the water hose 50 slope up respectively toward the water filling cup 16 and the thermostat case 17. Thus, the water filling cup 16 and the thermostat case 17 are located at the highest position in the cooling water circulating passage.

While the temperature of the cooling water in the thermostat case 17 is lower than the predetermined temperature after the engine 3 has been started, the thermostat 17*a* held in the thermostat case 17 keeps the water passage closed and hence the cooling water is scarcely circulated. The thermostat 17*a* opens the water passage after the temperature of the cooling water in the thermostat case has risen beyond the predetermined temperature. Then the cooling water discharged through the water outlets 57 and 58 of the water jackets of the engine 3 flows through the return pipes 48 and 49, the thermostat case 17, the water filling cup 16, the water hose 50 and the water inlet 54 into the radiator 45. The cooling water cooled while the same is flowing through the radiator 45 is sucked through the supply pipe 47 into the water pump 46 and is pumped by the water pump 46 into the water jackets of the engine 3. Thus the cooling water is circulated through the cooling water circulating passage including the radiator 45 to cool the engine 3.

The cooling water is inspected before using the engine 3 for the first time. If the cooling water is insufficient, the cover 35 is removed from the protruded portion 18, a hand is inserted through the access opening 34 into the protruded portion 18 to remove the cap 56, and then cooling water is supplied through the water filling opening 16*a* into the engine cooling system. Normally, the water passage is closed by the thermostat 17*a* when cooling water is thus supplied through the water filling opening 16*a* into the engine cooling system. Therefore, most part of the cooling water supplied through the water filling opening 16*a* of the water filling cup 16 flows through the water hose 50 and the water inlet 54 into the radiator 45. Then the cooling water flows through the supply pipe 47 and the water pump 46 into the water jackets of the engine 3. When the cooling water is thus supplied, air remaining in the water jackets bleeds through the return pipes 48 and 49 and the thermostat case 17 and is discharged through the water filling opening 16*a*. Air remaining in the radiator 45 bleeds through the water inlet 54 formed in the upper wall thereof into the water filling cup 16 and is discharged through the water filling opening 16*a*.

Since the water filling cup 16 is disposed at the level above the upper longitudinal pipes 21, the pressure head differences between the pressure head at the water filling opening 16*a* at a level $H_1$, and the pressure heads at the water outlets 57 and 58 of the water jackets of the engine 3 and the water inlet 54 of the radiator 45 at levels $H_2$, $H_3$ and $H_4$, respectively, are large. Therefore, the cooling water supplied through the water filling opening 16*a* is able to flow quickly through the radiator 45 into the water jackets.

Naturally, the present invention is applicable to other all-terrain vehicles other than the all-terrain vehicle specifically described herein and provided with other types of engines or engines having other number of cylinders other than two cylinders.

In the engine cooling system according to the embodiment of the present invention for the all-terrain vehicle provided with the engine 3 mounted on the body frame F at a position between the front and the rear wheels, the radiator 45 is disposed in the front part of the body frame F, the water filling cup 16 provided with the water filling opening 16*a* is separated from the radiator 45, and the water filling cup 16 and the thermostat 17*a* are placed at the highest level in a part of the water passage between the water inlet 54 of the radiator 45 and the outlets 57 and 58 of the water jackets in the cooling water circulating passage, and in a space under the front fender and near the steering handlebar. Thus, the pressure head differences between the pressure head at the water filling opening 16*a*, and the pressure heads at the water outlets 57 and 58 of the water jackets of the engine 3 are large. Therefore, air remaining in the cooling water circulating passage is able to bleed easily and water supplying work can be efficiently carried out. Air remaining in the water jackets of the engine 3 is able to bleed smoothly when cooling water is supplied through the water filling opening 16*a* into the engine cooling system.

In the engine cooling system according to the embodiment of the present invention, the protruded portion 18 is formed on the front fender 12 so as to surround the steering shaft 7*a*, the water filling cup 16 and the thermostat case 17 holding the thermostat 17*a* therein, and the protruded portion 18 provided with the access opening 34. Thus the water filling opening 16*a* of the water filling cup 16 and the thermostat case 17 holding the thermostat 17*a* therein can be easily disposed at a high level, and the cap 56 of the water filling cup 16 can be easily removed by reaching out a hand through the access opening 34 to the cap 56, and water can be easily supplied through the water filling opening 16*a* of the water filling cup 16 into the engine cooling system.

In the engine cooling system according to the embodiment of the present invention, the water inlet 54 is formed in the upper wall of the radiator 45. Thus the connecting line connecting the water inlet 54 of the radiator 45 and the outlets 57 and 58 of the water jackets of the engine 3 can be easily arranged and air can be easily removed from the cooling water circulating passage and cooling water can be easily supplied into the engine cooling system.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. An engine cooling system for an all-terrain vehicle provided with a front fender, a steering handlebar and an engine provided with a water jacket and mounted on a body frame at a position between front and rear wheels, said engine cooling system comprising:

a radiator provided with a water inlet and disposed in a front part of the body frame;

a water filling cup provided with a water filling opening covered with a cap, said water filling cup being formed as a different body from the radiator;

a thermostat case holding a thermostat therein, the thermostat case having an inlet and an outlet, the thermostat case being formed integrally with the water filling cup such that the outlet communicates with the water filling cup;

a first connecting pipe for connecting an outlet of the water jacket of the engine and the inlet of the thermostat case, the first connecting pipe being arranged so as to extend upward from the outlet of the water jacket to the inlet of the thermostat case; and a second connecting pipe for connecting an inlet of the radiator and the water filling cup, the second connecting pipe being arranged so as to extend downward from the water filling cup to the inlet of the radiator, wherein the water filling cup and the thermostat case with the thermostat are placed apart from the radiator and the outlet of the water jacket of the engine, at the highest part of a cooling water circulating passage of the engine cooling system, and are located in a space under the front fender and near the steering handlebar.

2. The engine cooling system according to claim 1, wherein a protruded portion is formed on the front fender so as to surround a steering shaft connected to the steering handlebar, the water filling cup and the thermostat case are placed inside the protruded portion, and the protruded portion is provided with an access opening for the water filling cap.

3. The engine cooling system according to claim 1, wherein the water inlet of the radiator is formed in an upper wall of the radiator.

4. The engine cooling system according to claim 1, wherein the engine is a two-cylinder V engine having a front cylinder tilted forward and a rear cylinder tilted rearward, each of the front cylinder and the rear cylinder has the outlet of the water jacket on an upper part of each of the cylinders, and the thermostat case has two inlets, each of the two inlets and the outlet provided in each of the cylinders is connected independently to each other by the first connecting pipe.

5. The engine cooling system according to claim 1, further comprising fastening means for fastening the thermostat case and the water filling cup to each other and for fitting the thermostat case and the water filling cup on a part of the body frame existing between the radiator and the engine.

6. An all-terrain vehicle, comprising:

an engine provided with a water jacket and mounted on a body frame at a position between front and rear wheels;

a radiator provided with a water inlet and disposed in a front part the body frame;

a steering handlebar disposed between the engine and the radiator;

a front fender covering a front part of the body frame and disposed forward to the engine; and an engine cooling system for cooling the engine;

said engine cooling system comprising:

a water filling cup provided with a water filling opening covered with a cap, said water filling cup being formed as a different body from the radiator;

a thermostat case holding a thermostat therein, the thermostat case having an inlet and an outlet, the thermostat case being formed integrally with the water filling cup such that the outlet communicates with the water filling cup;

a first connecting pipe for connecting an outlet of the water jacket of the engine and the inlet of the thermostat case, the first connecting pipe being arranged so as to extend upward from the outlet of the water jacket to the inlet of the thermostat case; and a second connecting pipe for connecting an inlet of the radiator and the water filling cup, the second connecting pipe being arranged so as to extend downward from the water filling cup to the inlet of the radiator, wherein the water filling cup and the thermostat case with the thermostat are placed, apart from the radiator and the outlet of the water jacket of the engine, at the highest part of a cooling water circulating passage of the engine cooling system, and are located in a space under the front fender and near the steering handlebar.

7. The all-terrain vehicle according to claim 6, wherein a protruded portion is formed on the front fender so as to surround a steering shaft connected to the steering handlebar, the water filling cup and the thermostat case are placed inside the protruded portion, and the protruded portion is provided with an access opening for the water filling cap.

8. The all-terrain vehicle according to claim 6, wherein the water inlet of the radiator is formed in an upper wall of the radiator.

9. The all-terrain vehicle according to claim 6, wherein the engine is a two-cylinder V engine having a front cylinder tilted forward and a rear cylinder tilted rearward, each of the front cylinder and the rear cylinder has the outlet of the water jacket on an upper part of each of the cylinders, and the thermostat case has two inlets, each of the two inlets and the outlet provided in each of the cylinders is connected independently to each other by the first connecting pipe.

10. An engine cooling system for an all-terrain vehicle provided with a front fender, a steering handlebar and an engine provided with a water jacket and mounted on a body frame at a position between front and rear wheels, said engine codling system comprising:

a radiator provided with a water inlet and disposed in a front part of the body frame;

a water filling cup provided with a water filling opening covered with a cap, said water filling cup being formed as a different body from the radiator; and a thermostat case holding a thermostat therein, wherein the water filling cup and the thermostat case are placed in a part of a connecting pipe connecting the water inlet of the radiator and an outlet of the water jacket, at the highest part of a cooling water circulating passage and located in a space under the front fender and near the steering handlebar, and wherein a protruded portion is formed on the front fender so as to surround a steering shaft connected to the steering handlebar, the water filling cup and the thermostat case are placed inside the protruded portion, and the protruded portion is provided with an access opening for the water filling cap.

11. The engine cooling system according to claim 10, wherein the water inlet of the radiator is formed in an upper wall of the radiator.

* * * * *